United States Patent [19]

Tateishi

[11] Patent Number: 4,743,739

[45] Date of Patent: May 10, 1988

[54] OSCILLATING LOUVER ELECTRIC FAN HEATER

[76] Inventor: Arthur K. Tateishi, 25 Warrender, Apt. 202, Toronto, Ontario, Canada

[21] Appl. No.: 831,190

[22] Filed: Feb. 20, 1986

[51] Int. Cl.[4] ..... F24H 3/04; H05B 1/00; F04D 25/10; F24F 13/16

[52] U.S. Cl. ..... 219/368; 98/40.3; 98/121.2; 165/99; 219/366; 219/370; 219/371; 219/373; 415/125; 416/100; 417/361

[58] Field of Search ..... 219/366–372, 219/365, 359, 373; 165/99; 415/125; 98/40.3, 121.2; 417/361; 416/100

[56] References Cited

U.S. PATENT DOCUMENTS

| | | | |
|---|---|---|---|
| 697,448 | 4/1902 | Coleman | 415/125 |
| 2,018,535 | 10/1935 | Rober | 165/99 X |
| 2,036,597 | 4/1936 | Meyrowitz | 219/371 |
| 2,037,250 | 4/1936 | MacDonald | 415/125 |
| 2,124,716 | 7/1938 | Sperry | 165/99 X |
| 2,768,782 | 10/1956 | Tateishi | 417/361 |
| 3,173,478 | 3/1965 | Maycen | 219/370 X |
| 3,380,372 | 4/1968 | Perry | 98/121.2 |
| 4,084,491 | 4/1978 | Spotts | 98/121.2 |
| 4,217,816 | 8/1980 | Mancinelli | 415/125 X |
| 4,437,394 | 3/1984 | Tateishi | 98/40.3 |

FOREIGN PATENT DOCUMENTS

| | | | |
|---|---|---|---|
| 642202 | 2/1937 | Fed. Rep. of Germany | 415/125 |
| 451597 | 8/1936 | United Kingdom | 415/125 |
| 630391 | 10/1949 | United Kingdom | 416/100 |
| 654893 | 7/1951 | United Kingdom | 415/125 |
| 927134 | 5/1963 | United Kingdom | 415/125 |

*Primary Examiner*—Anthony Bartis

[57] ABSTRACT

A fan heating includes a stationary housing and a louvre blade assembly having at least one oscillating louvre blade located forwardly in the housing for providing multidirectional hot air flow from the heater. The heater further includes a drive system for the louvre blade assembly with the drive system itself including lightweight plastic drive gears located rearrwardly in the housing and a lightweight plastic connecting shaft extending forwardly from the drive gears to the louvre blade assembly. Positioned between the louvre blade assembly and the drive gears are an electric heating element for providing the hot air and a fan blade for circulating the hot air which is operated from a motor also operating the drive gears through a rubber drive belt. The drive gears and belt are located in said housing laterally outwardly away from the heating element. The fan blade is positioned to move the hot air forwardly from the heating element to the louvre blades and away from the drive gears and to move cooling air to the drive gears and connecting shaft to prevent heat related damage thereto.

6 Claims, 4 Drawing Sheets

43
3
53a
11
5a
33
37
53
27
29
57
5
70
31
49
47
51
ELECTRIC
HEATER
53a
11
5a

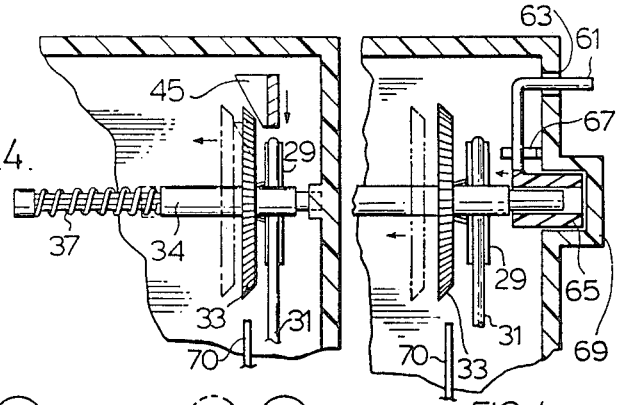
FIG.4.
FIG.4a.
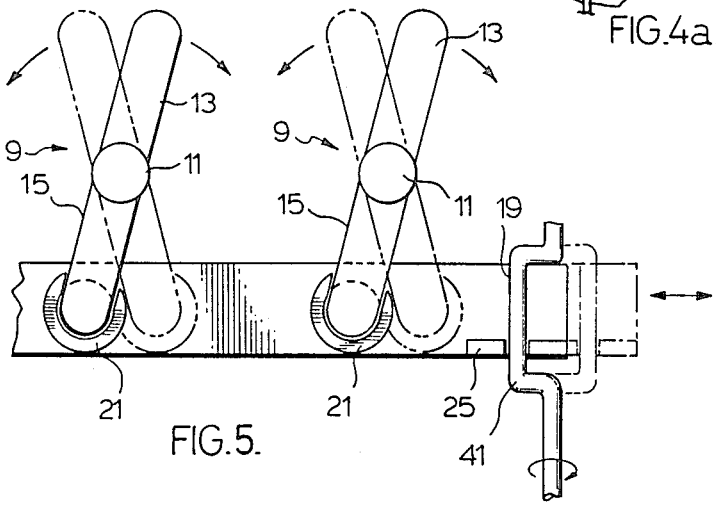
FIG.5.
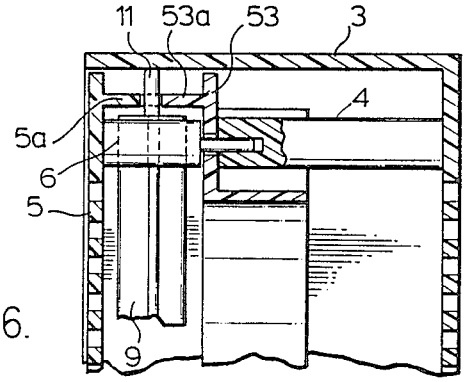
FIG.6.

OSCILLATING LOUVER ELECTRIC FAN HEATER

FIELD OF THE INVENTION

The present invention relates to a fan heater with a stationary housing and louvre blades which oscillate relative to the housing to provide a multidirectional hot air flow from the heater.

BACKGROUND OF THE INVENTION

Over the last few years there has been a very substantial demand for portable electric heaters which can be moved from room to room in a house or building. Some of these heaters operate using radiant or convection heating techniques. In addition there are many newly designed portable heaters which operate using a fan heater and these fan type heaters have been particularly well suited for the most up to date molding techniques which has resulted in even more compact constructions adding to the portability of the fan heater.

One noticeable drawback resulting from the most recent fan heater constructions as described immediately above is that they are very localized in terms of direction of air flow from the heater, i.e. the hot air is blown in one direction only and because the heaters themselves are quite small this limits the area covered by the heater.

I have earlier developed an oscillating louvre arrangement for use in a fan construction as covered in Canadian Pat. No. 1,130,251 issued Aug. 24, 1982 and it's counterpart corresponding U.S. Pat. No. 4,437,394 issued Mar. 20, 1984. The specific modular construction from my earlier fan is also covered by Canadian Pat. No. 1,169,828 issued June 26, 1984. The concept of movable louvres as described in the above noted patents would provide substantially increased heat coverage when used in combination with a heater fan. However, it is important that the gearing used to drive the louvre blades should not be affected by heat buildup within the heater fan particularly in view of the potential of using lightweight plastics in the construction of this gearing.

SUMMARY OF THE PRESENT INVENTION

The present invention provides a fan heater designed for increasing heating coverage in comparison to a conventional fan heater without being subjected to heat buildup problems. More particularly the fan heater of the present invention comprises a stationary housing, a louvre blade assembly having at least one oscillating louvre blade located forwardly in the housing for providing multidirectional hot air flow from the heater, a drive system for the louvre blade assembly with the drive system including gear means located rearwardly in the housing and a connecting shaft extending forwardly from the gear means to the louvre blade assembly. Also provided are air heating means for providing the hot air, a fan blade for circulating the hot air and a motor for operating both the fan blade and the gear means. In accordance with the objectives of the present invention the fan blade is positioned to move the hot air forwardly from the air heating means to the louvre blade and away from the gear means and to move cooling air to the gear means to prevent heat related damage to the drive system for the louvre blade assembly.

BRIEF DISCUSSION OF THE DRAWINGS

The above as well as other advantages and features of the present invention will be described in greater detail according to the preferred embodiments of the present invention in which:

FIG. 4 is a side plan view of the control region for the drive system from the fan heater of FIG. 1.

FIG. 4*a* is a side plan view of an alternate control region for the drive system according to a further preferred embodiment of the present invention.

FIG. 5 is a top plan view of the louvre blade assembly showing oscillation of the louvre blades.

Figure 1:
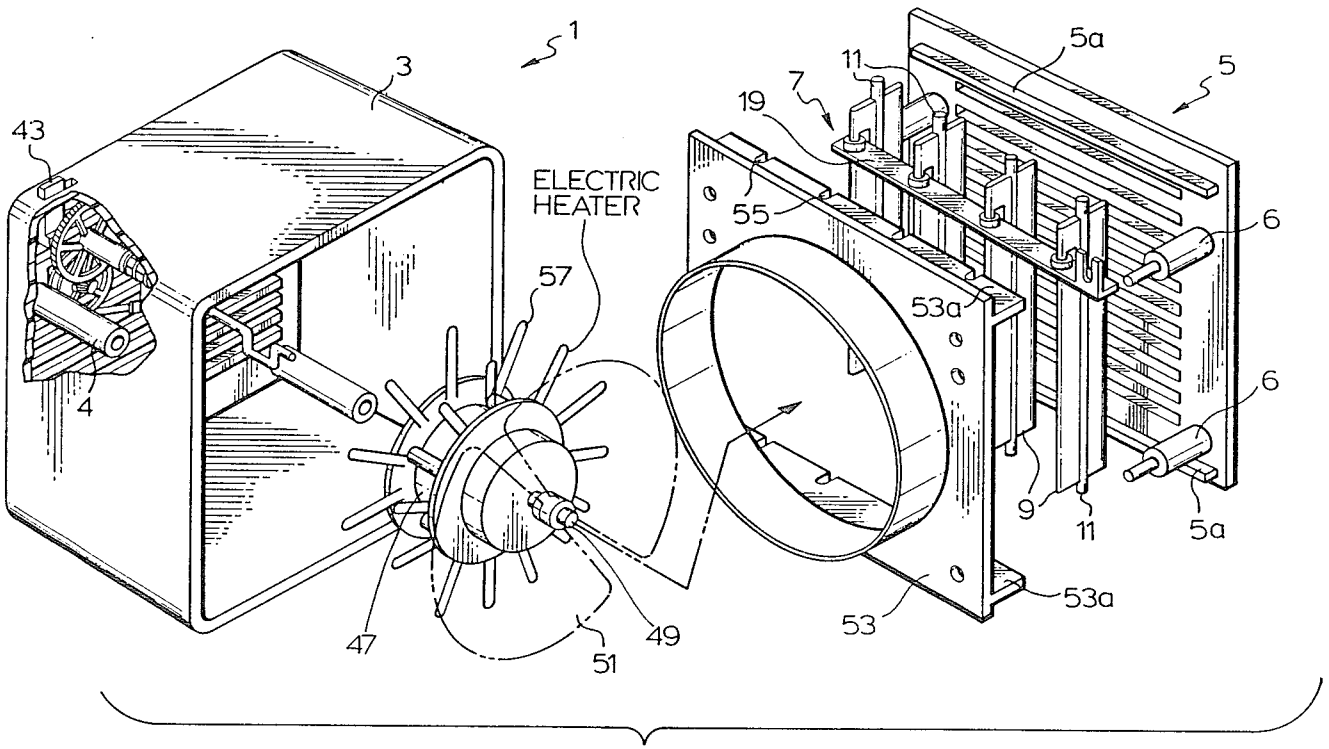
FIG. 1 is an exploded perspective view of a fan heater according to a preferred embodiment of the present invention.

FIG. 6 is a sectional view at the upper end of the fan heater of FIG. 1 when fully assembled and in particular showing the fitting of the louvre blades to the fan housing according to a preferred embodiment of the present invention.

DETAILED DESCRIPTION ACCORDING TO THE PREFERRED EMBODIMENTS OF THE PRESENT INVENTION

Figure 2:
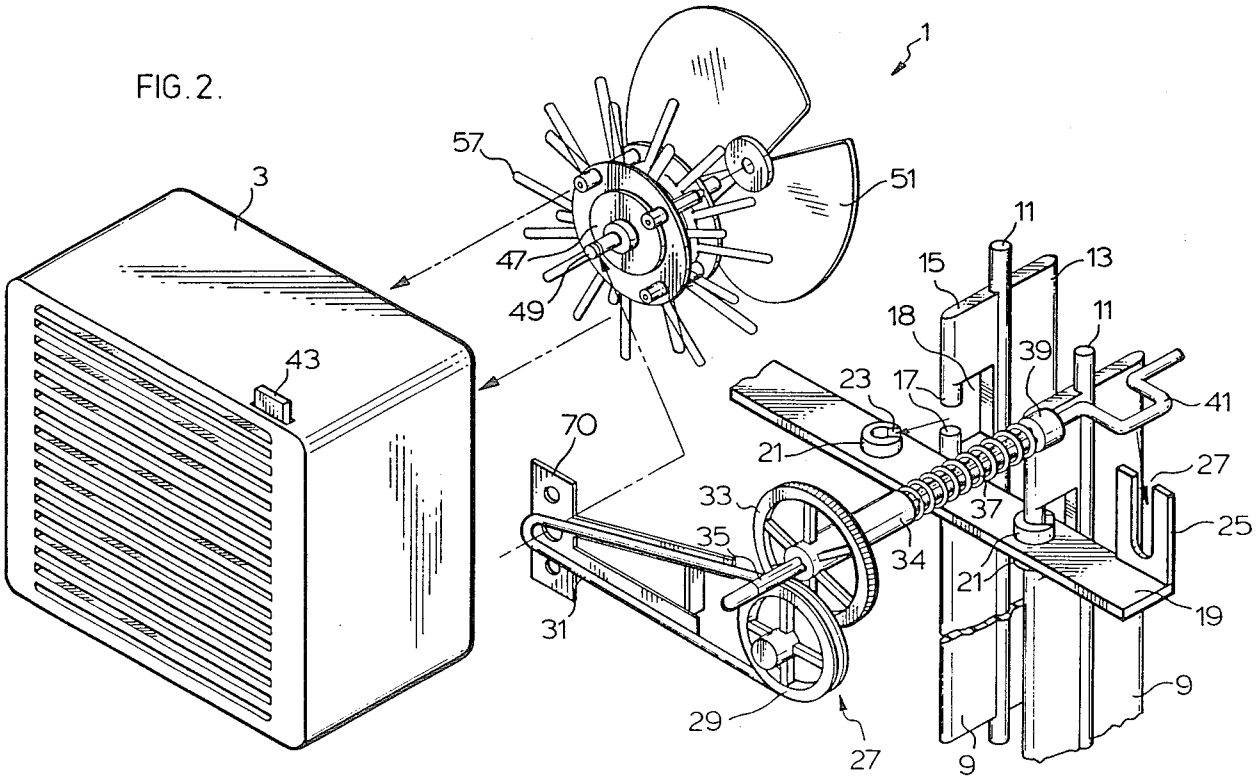
FIG. 2 is a further exploded perspective view showing a partial enlargement of the drive system and louvre blade assembly from the fan heater of FIG. 1.

FIGS. 1 and 2 show the components for the overall heater construction generally indicated at 1. These components include a main casing portion 3 which forms the side, top, bottom and back wall regions of the heater housing which is then completed at the forward side of the housing by casing portion 5. It is to be noted that the housing itself remains stationary while the fan heater is in operation.

The main operating components located within the housing comprise an electrical motor 47 which operates a fan blade 51, an electrical resistance heater 57 located immediately around motor 47, a louvre blade assembly generally indicated at 7 in FIG. 1 and positioned at the front of the housing and a drive system generally indicated at 27 in FIG. 2 which is operated from motor 47 for providing oscillation of the louvre blade assembly.

The louvre blade assembly itself consists of a plurality of individual louvre blades 9 each of which includes upper and lower central pivot mounting 11 rotatably fitted within the casing as well shown in FIG. 3 of the drawings and to be described later in greater detail.

Returning to FIG. 2, each of the louvre blades 9 includes spaced apart rounded arms 17 which slide through slots 23 into bosses 21 on the upper and lower sides of control bar 19 to which the louvre blades are coupled. It will be noted that the slots in the bosses are angled along the longitudinal axis of bar 19 which when the fan is unassembled allows easy insertion of arms 17 into the bosses, but which once the fan is assembled prevents the arms from sliding out of the bosses and insuring coupling of the louvre blades with the control bar. It will also be seen in FIG. 2 that the louvre blades themselves are actually recessed as indicated at 18 to permit their side to side movement without interference from bar 19 when the louvre blade assembly is in operation.

Drive system 27 for the louvre blade operation includes a first drive wheel 29 which is coupled by means of endless belt 31 directly to output shaft 49 of electric motor 47. As seen in FIG. 2 the shaft is recessed to positively receive belt 31. The drive system also includes a further drive wheel 33 slideably mounted on and rotatably coupled to a connecting shaft 35 extending forwardly from the drive wheels to the louvre blade assembly. Drive wheel 33 is normally biased into contact with drive wheel 29 by means of spring 37 trapped between extension 34 of wheel 33 and a stop portion 39 forming part of the connecting shaft. The actual meshing between wheels 29 and 33 can be well seen in the upper left hand corner of FIG. 3 of the drawings showing spring 37 in its naturally extended condition.

Connecting shaft 35 is provided at its forward end with a crank portion 41 which fits into slot 27 of a generally U shaped upright crank receiving portion 25 of control bar 19. This arrangement operates in a manner such that when gear wheel 33 driven off gear wheel 29 rotates connecting shaft 35 there is an orbital movement at crank portion 41 which causes control bar 19 to reciprocate from side to side across the front of the fan housing. This provides an oscillation of each of the louvre blades 9 as well seen in FIG. 5 of the drawings.

Figure 3:
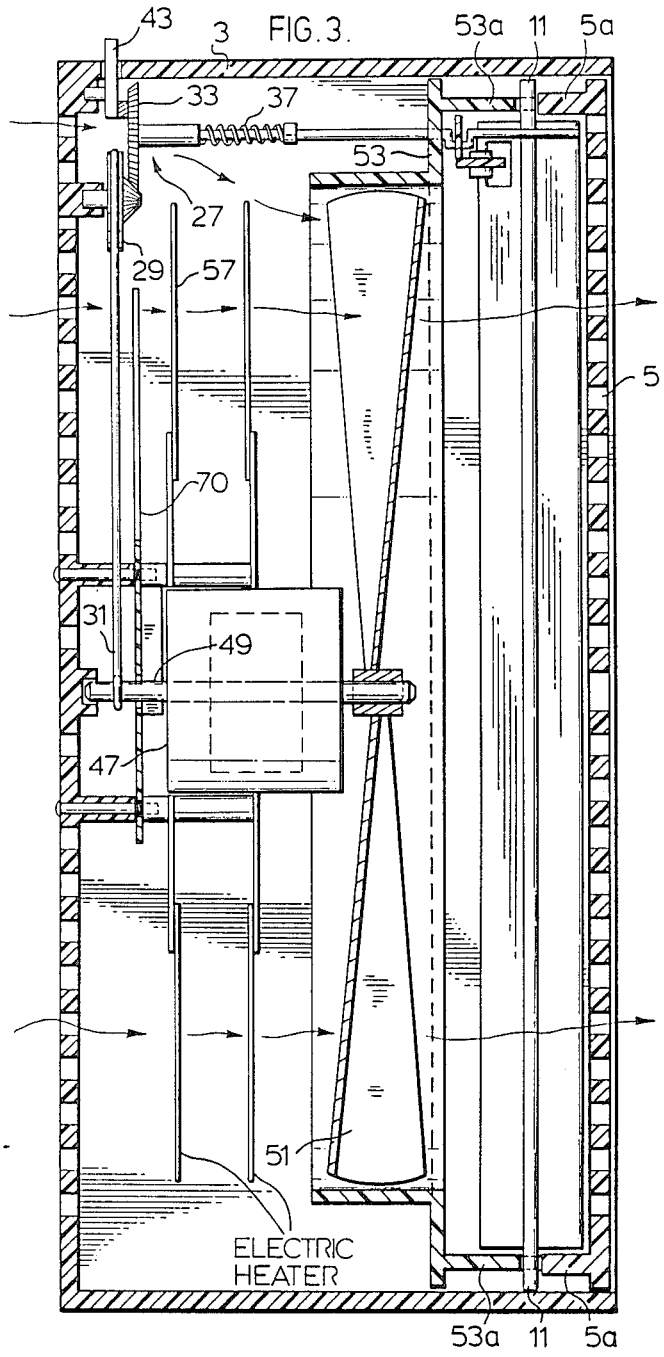
FIG. 3 is a sectional view through the fan heater of FIG. 1 when fully assembled.

The actual mounting of the louvre blade assembly is best seen having reference to FIGS. 1, 3 and 6 of the drawings. Referring particularly to FIG. 1, the fan housing includes a fan blade guide 53 having a forwardly projecting shelf 53*a* provided with a plurality of slots or openings 55. This shelf cooperates with the rearwardly projecting shelf 5*a* on forward housing or casing portion 5 at both the upper and lower ends of the fan for trapping the pivot pins or mounts 11 on the louvre blades as clearly seen in FIG. 3 of the drawings. The entire housing with the components fitted as described above is secured by means of posts 6 on the forward housing portion fitting into the forwardly projecting studs 4 on the main housing portion 3 as seen in FIG. 1.

When the fan is in operation fan motor 47 rotates fan blade 51 which draws air in through the vented back of the heater and forces that air forwardly past the louvre blades out the front vents of the heater as well as seen in FIG. 3.

It will be noted that fan blade 51 is mounted to the forward end of motor shaft 49 while belt 31 wraps around the back end of the motor output shaft. Accordingly, both the fan blade and the drive system for the louvre blade assembly run off the same fan motor and an important feature of the present invention is the use of lightweight plastic components in forming both the drive system and the louvre blade assembly so as to minimize power requirements for operation of the louvre blades and allow the use of a single motor to both rotate the fan blade and operate the louvre blade assembly. In addition, each of the louvre blades is set up to have a balanced air flow load between the front and rear blade portions 13 and 15 respectively of the louvre blades. More specifically, as the fan blade blows the air forwardly to the louvre blades the air impact or load is equal at the front and the back of each louvre blade so that there is no overall biasing effect created by the air flow. Otherwise there would be a resistance to oscillation of each of the blades requiring more power from the fan motor to overcome this potential resistance. However by providing the central pivot mounting of each of the louvre blades with an equal amount of blade portion to either side of the pivot point, there is a balanced load on the louvres resulting in substantially no power drain from the motor in operating the louvre blade assembly.

As typically the case the fan heater of the present invention can operate in either strictly the fan mode for summer use or in a heater mode for winter use. This is controlled through an on/off control member not shown in the drawings and not forming part of the present invention. However it is to be noted that the heater can not be operated without the fan and one of the critical features of the present invention relates to the positioning of the internal operating components with the fan being used to prevent heat related damage when operated in the heating mode.

Referring again to FIG. 3 it will be seen that electrical resistance heater 57 providing the source of heat energy for the hot air blown from the heater is positioned forwardly of the drive belt and gear wheels for drive system 27 which are themselves positioned generally to the rear of the housing. Therefore the drive belt, the gear wheels and the heater are all on the negative pressure side of fan blade 51 which when rotating, and as earlier described, draws air in through the back of the housing and forces the air forwardly through the louvre blade assembly. Accordingly, the fan blade pulls the hot air forwardly from heater 57 away from the drive belt and gear wheels and also draws cooling air forwardly to the gear wheels through the back of the housing. Therefore, there is very little if any heat buildup rearwardly of the heater where the gear wheels have been specifically located in an effectively cooled region of the heater. It is to be noted that the heater will not operate without rotation of the fan blade.

This effective isolation of the drive system away from the heat generated by the electrical resistance heater is particularly important when again bearing in mind the lightweight plastic and preferrably nylon construction of the gear wheels which might otherwise be subject to warping problems and the like due to excessive heat buildup. As a further preferred embodiment feature it is to be noted that each of the gear wheels 29 and 33 has an open spoke construction extending in an upright position sideways across the housing such that the cooling air brought in from the back of the housing actually flows directly through and further cools the two drive wheels. In addition the connecting shaft from the drive wheels forwardly to the louvre blade assembly is isolated from the effects of heater 57 by the air flow characteristics created by fan blade 51 as clearly seen in FIG. 3.

Again it is to be remembered that the use of lightweight plastics material in the drive system construction lends itself extemely well to operation of both the drive system and the fan blade from a single small powered motor with little if any power drain on the motor because of the very limited load required to operate these lightweight components. In fact it would appear that because of the balanced load on each of the louvres the only resistance to operation of the drive system is the friction of the components and because this resistance is so limited the components themselves are made in a very small size further reducing resistance. By way of example belt 31 has a diameter of about 1/16" which is all that is required to operate the entire drive system for the louvre blades.

All of the description above relates to the louvre blade assembly operating in conjunction with the fan motor, however according to a further preferred embodiment of the present invention the heater fan is provided with an on/off control for disconnecting the drive system to the louvre blade assembly while the fan motor is in operation. This on/off control is best seen in FIGS. 3 and 4 of the drawings.

More specifically, provided to the rear of the housing is an on/off button 43 having a bevelled or cammed lower end 45. When the button is in the up position the bevelled end 45 is out of contact with the louvre blade drive system, however by depressing button 43 bevelled end 45 engages with the bevelled surface on gear wheel 33 as shown in FIG. 4 and forces this gear wheel to slide forwardly against the spring on shaft 34 which seats in a bearing at the front of the housing to prevent movement of the shaft itself. Therefore, although gear wheel 33 normally meshes with gear or drive wheel 29 when spring 37 is in its naturally extended position the two gear wheels can be separated from one another by control button 43 to interrupt rotation of shaft 35 and discontinue any further oscillation of the louvre blades. As soon as control button 43 is moved back to its up or elevated position cam surface 45 moves away from gear wheel 33 allowing spring 37 to force the gear wheel back into meshing engagement with drive wheel 29 which continues to rotate regardless of the positioning of control button 43 as long as the fan is in operation.

FIG. 4*a* shows a modified louvre drive system control comprising a sliding on/off switch 61 fitted through an elongated slot 63 at the back of the housing and a cam surface 67 over which switch 61 slides for disengaging louvre oscillation. Switch 61 includes its own cup portion 65 which fits into bearing region 69 of the housing casing. By sliding switch 61 over cam surface 67 cup portion 65 pushes wheel 33 away from wheel 29 to discontinue rotation of shaft 34 and turn off louvre oscillation. When switch 61 is not sitting on cam surface 67 wheels 33 and 29 engage one another because of pressure from spring 37 to provide oscillation of the louvre blades.

One very useful feature of providing the on/off control for the oscillation drive is that by simply disengaging the two drive wheels at the appropriate time the louvres can be set at any desired position. With this arrangement the direction of air flow is easily controlled and varied without having to move the heater itself which can be critical when working in tight space constraints.

From the description above it will now be clearly seen how even a very small fan heater made with the most up to date plastics and plastic moulding techniques will provide heat coverage for large areas by incorporating the louvre concept of the present invention.

Although various preferred embodiments of the invention have been described herein in detail it will be appreciated by those skilled in the art that variations may be made thereto without departing from the spirit of the invention or the scope of the appended claims.

The embodiments of the invention in which an exclusive property or privilege claimed are defined as follows:

1. A fan heater comprising a stationary housing having a front surface with an air outlet and a back surface with an air inlet, a louvre blade assembly having a series of oscillatable louvre blades located adjacent said air outlet at said front surface for providing multi-directional air flow from said air outlet, a drive system in said housing for said louvre blade assembly, said drive system comprising lightweight plastic gear means and a rubber drive belt positioned adjacent said back surface and a rotatable lightweight plastic connecting shaft extending forwardly from said gear means to means associated with said louvre blade assembly for converting rotation of said shaft to oscillation of said louvre blades, said back surface being vented through said air inlet for outside air movement to said drive system, electric air heating means in said housing for heating the air interiorly of said housing flowing from said air inlet to said air outlet, a fan blade in said housing for circulating the flow of heated air and a motor in said housing for operating both said fan blade and said drive belt for said gear means, said plastic gear means and said connecting shaft being located laterally outwardly away from said electric air heating means to avoid direct exposure to heat therefrom, said fan blade being positioned between said louvre blade assembly and said plastic gear means and rubber drive belt to move the heated air forwardly away from said electric air heating means to said louvre blades and away from said plastic gear means and rubber drive belt and to draw in the outside air through the air inlet of said back surface of said housing to cool said plastic gear means and rubber drive belt for preventing heat related damage thereto.

2. A fan heater as claimed in claim 1 wherein said gear means has an open spoke construction comprising solid peripheral and central portions and a series of radial spokes therebetween, said gear means extending sideways across said housing perpendicular to the direction of air flow from said air inlet to said air outlet for flow of the cooling air directly therethrough.

3. A fan heater as claimed in claim 1 wherein said air heating means comprises a resistance coil positioned between said fan blade and said gear means, said fan blade creating a negative pressure and drawing heated air forwardly from said resistance coil to said louvre blades and also drawing cooling air through the air inlet of said back surface of said housing to said gear means.

4. A fan heater as claimed in claim 1 wherein said gear means comprises at least a first spoked gear wheel coupled through said rubber drive belt to the output shaft of said motor.

5. A fan heater as claimed in claim 1 wherein said connecting shaft is rotated by said gear means which comprises first and second spoked gear wheels, said first gear wheel being coupled directly with the output shaft of said motor by said rubber drive belt, said second gear wheel being biased by spring pressure to mesh with said first gear wheel and being mounted on and rotating said connecting shaft which includes a crank portion fitted with said louvre blade assembly causing oscillation of said louver blades with rotation of said connecting shaft.

6. A heater fan as claimed in claim 5 wherein said second gear wheel is selectively slideable longitudinally along said connecting shaft against the spring pressure away from said first gear wheel to interrupt rotation of said connecting shaft and thus oscillation of said louvre blade while continuing operation of said motor and including an oscillation control switch movable over a cam region on said housing to push on said second gear wheel to slide same away from said first gear wheel when it is desired to stop oscillation of said louvre blades.

* * * * *